US007753580B2

(12) United States Patent
Woehl et al.

(10) Patent No.: US 7,753,580 B2
(45) Date of Patent: Jul. 13, 2010

(54) MICROSTRUCTURE DESIGNS FOR OPTIMIZING MIXING AND PRESSURE DROP

(75) Inventors: Pierre Woehl, Cesson (FR); Jean-Pierre Themont, Montigny sur Loing (FR); Yann P M Nedelec, Avon (FR)

(73) Assignee: Corning, Incorporated, Corning, NY (US)

( * ) Notice: Subject to any disclaimer, the term of this patent is extended or adjusted under 35 U.S.C. 154(b) by 733 days.

(21) Appl. No.: 11/150,652

(22) Filed: Jun. 10, 2005

(65) Prior Publication Data

US 2005/0276160 A1 Dec. 15, 2005

(30) Foreign Application Priority Data

Jun. 11, 2004 (EP) ..... 04291465

(51) Int. Cl.
*B01F 5/00* (2006.01)
*B01F 15/02* (2006.01)

(52) U.S. Cl. ..... 366/178.1; 366/340; 366/341; 366/DIG. 3

(58) Field of Classification Search ..... 366/341, 366/336, DIG. 3, DIG. 4, 178.1, 178.2, 178.3, 366/340
See application file for complete search history.

(56) References Cited

U.S. PATENT DOCUMENTS 4,222,671 A * 9/1980 Gilmore ..... 366/337
5,300,779 A * 4/1994 Hillman et al. ..... 250/341.1
5,904,424 A * 5/1999 Schwesinger et al. ..... 366/336
5,921,678 A * 7/1999 Desai et al. ..... 366/336
5,928,880 A * 7/1999 Wilding et al. ..... 366/DIG. 3
5,952,173 A * 9/1999 Hansmann et al. ..... 435/6
5,955,029 A * 9/1999 Wilding et al. ..... 366/DIG. 3

(Continued)

FOREIGN PATENT DOCUMENTS

DE 10103425 8/2002

(Continued)

OTHER PUBLICATIONS

Wong S. H. et al: "Investigation of mixing in a cross-shaped micromixer with static mixing elements for reaction kinetics studies" Sensors and Actuators B, Elsevier Sequoia S. A., Lausanne, CH, vol. 95, No. 1-3, Oct. 15, 2003, pp. 414-424 XP004454701, ISSN: 0925-4005.

*Primary Examiner*—Tony G Soohoo
(74) *Attorney, Agent, or Firm*—Gregory V. Bean; Joanne N. Pappas

(57) ABSTRACT

A class of designs is provided for a mixer in micro reactors where the design principle includes at least one injection zone in a continuous flow path where at least two fluids achieve initial upstream contact and an effective mixing zone (i.e. adequate flow of fluids and optimal pressure drop) containing a series of mixer elements in the path. Each mixer element is preferably designed with a chamber at each end in which an obstacle is placed (thereby reducing the typical inner dimension of the chamber) and with optional restrictions in the channel segments. The obstacles are preferably cylindrical pillars but can have any geometry within a range of dimensions and may be in series or parallel along the flow path to provide the desired flow-rate, mixing and pressure-drop. The injection zone may have two or more interfaces and may include one or more cores to control fluids before mixing.

7 Claims, 16 Drawing Sheets

U.S. PATENT DOCUMENTS

| | | | | |
|---|---|---|---|---|
| 6,170,981 | B1 * | 1/2001 | Regnier et al. | 366/336 |
| 6,190,034 | B1 * | 2/2001 | Nielsen et al. | 366/336 |
| 6,851,846 | B2 * | 2/2005 | Fujii et al. | 366/173.2 |
| 6,910,797 | B2 * | 6/2005 | Falcon | 366/127 |
| 7,066,641 | B2 * | 6/2006 | Honda | 366/340 |
| 7,080,937 | B1 * | 7/2006 | Salmela et al. | 366/341 |
| 7,318,902 | B2 * | 1/2008 | Oakey et al. | 366/336 |
| 2002/0175079 | A1 * | 11/2002 | Christel et al. | 366/336 |
| 2003/0082079 | A1 * | 5/2003 | Sawano | 422/100 |
| 2003/0123322 | A1 * | 7/2003 | Chung et al. | 366/165.1 |
| 2003/0133358 | A1 | 7/2003 | Karp | 366/341 |
| 2003/0165079 | A1 * | 9/2003 | Chen et al. | 366/165.1 |
| 2004/0027915 | A1 | 2/2004 | Lowe et al | |
| 2004/0032793 | A1 * | 2/2004 | Falcon | 366/341 |
| 2004/0035481 | A1 | 2/2004 | Lim et al. | 138/42 |
| 2004/0179427 | A1 * | 9/2004 | Yamazaki et al. | 366/341 |
| 2005/0041525 | A1 * | 2/2005 | Pugia et al. | 366/341 |
| 2005/0276160 | A1 * | 12/2005 | Woehl et al. | 366/336 |

FOREIGN PATENT DOCUMENTS

| | | |
|---|---|---|
| EP | 0150776 | 7/1985 |
| EP | 1604733 | * 12/2005 |
| WO | WO 02/096543 | * 12/2002 |

* cited by examiner

Mixers

Radius of obstacles:

| | |
|---|---|
| 800 & 870: | 700μm |
| 810 & 880: | 800μm |
| 820 & 890: | 900μm |
| 840 & 892: | 1100μm |
| 850 & 893: | 1200μm |
| 860 & 894: | 1300μm |

Height: 600μm

MICROSTRUCTURE DESIGNS FOR OPTIMIZING MIXING AND PRESSURE DROP

FIELD OF THE INVENTION

This invention relates generally to micro reactor systems and devices and more particularly to a class of designs for mixers used within micro reactor systems.

BACKGROUND OF THE INVENTION

Many multiphase fluidic applications require mixing or at least enhancement of interfacial area. In micro-fluidic systems, typical dimensions are below 1 mm and make the mixing and/or the agitation a first order issue. Indeed the typical flows often involved in these applications are creeping flows in which two initial miscible or non miscible fluids hardly mix by themselves (turbulence in fluid flows being commonly used for achieving mixing in large-scale fluid systems). Increasing the interfacial area between two fluids or mixing at very small scales without external stirring or mechanical action is very difficult because of the low Reynolds numbers involved, especially for nearly two dimensional geometries. Therefore, reaction processes are largely diffusion limited.

The concept of mixing liquids in a path is necessary to create adequate liquid flow in a micro reactor system or more particularly, in a mixer design or module within a micro reactor system. Typically, there is a source of reactants or a least a plurality of fluid connections for delivering reactants at an injection zone for upstream flow. Typically, liquids in the prior art include water, aqueous and organic liquid solutions.

Many have developed mixers of several types to generate mixing in micro systems. Whatever mixing solution is chosen, the mixer may be implemented within a complete micro system. The required attributes for the mixers are therefore extended beyond mixing efficiency, whereby mixer dimensions can preferably be changed to affect pressure drop, but not affect mixing efficiency or at least have a minimum effect on mixing efficiency.

In such micro reactor systems, it is therefore desirable to have a mixer with maximum efficiency at very low pressure drop. Furthermore, it is desirable to generate appropriate mixing within the structure of the path.

Prior art approaches for performing the above described desired capabilities that are known in the art include the following examples.

For instance, a typical split and recombine solution is shown in FIG. 1 and described in U.S. Pat. No. 5,904,424 A1 entitled "Device for Mixing Small Quantities of Liquids". In this patent, in order to reduce the length over which the reactants need to diffuse, the inlet reactant streams are separated and recombined in a multi-layered structure.

Further prior art implementations of this principle are disclosed by IMM. (Refer to http://imm.mediadialog24.de/v0/vvseitene/vvleistung/misch2.html). Here, the IMM mixing split-recombine concept of caterpillar mixers includes two unmixed fluid streams divided such that two new regions are formed and are further down recombined. All four regions are ordered alternatively next to each other such that the original geometry is re-established.

There are also prior art three-dimensional flows that represent chaotropic solutions. These designs solve the problem of mixing by creating a transverse flow without requiring the use of moving mixer elements. Another similar prior art chaotropic mixer can be found for instance, in International Publication Number WO03/011443A2, entitled, "Laminar Mixing Apparatus and Methods" assigned to the President and Fellows of Harvard College. Here, the helical flow is created by weak modulations of the shape of the walls of the channel, or by grooves defined on the channel wall allowing mixing of a fluid with a Reynolds number of less than 100 thereby capably mixing a fluid flowing in the micro-regime. A similar prior art structure is shown in FIG. 2.

Cellular Process Chemistry (CPC), a German company, cites a design using liquid slugs and a decompression chamber in European Patent Application EP1123734A2 entitled "Miniaturized Reaction Apparatus" published on Aug. 16, 2001 as shown in FIG. 3.

Disadvantages of these prior art solutions will be outlined below. For instance, with respect to the first prior art approach, split and recombine design requires significant dimensional precision for the manufacture of these designs. This is necessary to ensure that the upstream flow splits equally in each sub-channel before the recombination, so that the flowrates ratio of the liquid that are mixed is equal to the inlet ratio set by the user.

The second approach utilizing three-dimensional or chaotropic flows has several drawbacks, one being the aspect ratio between the height and width of the channel, another being costly technology, and yet another being that it is useful for liquids only and not gas-liquid systems.

The third prior art approach, the liquid slugs device similarly has all the drawbacks of those approaches described above. Its only advantage is that low pressure drop due to parallelization and decompression reduces dimensions efficiently.

All the above devices have great difficulty achieving low pressure drop. This is generally thought to be caused by the prior art designs' attempts at reducing dimensions to enhance mixing efficiency thereby dramatically increasing the pressure drop, which is a penalty.

A new approach is needed that preferably overcomes the disadvantages of any of the prior art solutions above that provide optimal pressure drop by tuning inner dimensions; localized liquid flow at geometric obstacles and restrictions in the path structure; mixing generated in the path structure via obstacles and by reducing local dimensions; fully three dimensional flow between obstacles; control at the initial contact region at injection; and robustness of efficiency with respect to fluids.

The term fluid is herein defined as including miscible and immiscible liquid-liquids, gas-liquids and solids.

SUMMARY OF THE INVENTION

A class of designs is provided for a mixer in microreactors where the design principle includes an injection zone with one or more interfaces and cores where two or more fluids achieve initial upstream contact and an effective mixing zone containing a series of mixer elements in the flow path and wherein each mixer element is designed with a chamber at the end in which an obstacle such as a pillar is placed to reduce the typical inner dimension and an optional restriction in the channel segment. Additionally, the preferred embodiment can have many permutations in its design whereby for instance, it can also include an injection-mixing-injection concept where additional fluid-mixing is done further downstream.

One embodiment of the present invention relates to a mixer apparatus having at least one injection zone of a continuous flow path where a plurality of fluids make initial contact and at least one mixer element in the flow path, the at least one mixer element efficiently mixing the fluids through the path.

Each one of the mixer elements includes a channel segment, a chamber disposed at ends of the channel segment and each chamber further includes at least one obstacle.

Another embodiment of the present invention relates to at least one obstacle situated anywhere in the flow path.

Another embodiment of the present invention relates to the channel segment further including at least one restriction, the segment having a radius in the range of 100 μm to 5000 μm, height in the range of 100 μm to 5000 μm, a width in the range of 100 μm to 10000 μm, and a length in the range of 200 μm to 10000 μm and the restriction having a a height in the range of 100 μm to 5000 μm and a width in the range of 50 μm to 2500 μm.

Another embodiment of the present invention relates to inner dimensions of the chamber being reduced in the presence of the at least one obstacle and wherein increased dimensions of said obstacle increase the mixing efficiency.

Another embodiment of the present invention relates to the at least one obstacle having any geometry with a radius in the range of 50 μm to 4000 μm and a height of 100 μm to 5000 μm and wherein the inner dimensions of the chamber in the presence of the at least one obstacle are further characterized by a radius in the range of 100 μm to 5000 μm, a perimeter from 600 μm to 30 mm, a surface area from 3 $mm^2$ to 80 $mm^2$, a volume from 0.3 $mm^3$ to 120 $mm^3$, and a height in the range between 100 μm and 5000 μm.

Another embodiment of the present invention relates to the at least one injection zone having at least one core and fluids in the at least one core flow through and towards a plurality of interfaces.

Another embodiment of the present invention relates to the mixer apparatus being embedded in a micro reactor system, the system including at least one of the following: a reactant fluid source, a pump, a dwell time zone and an output filter.

Another aspect of the embodiment of the present invention relates to the mixer apparatus preferably made of glass, ceramic or glass-ceramic substrate materials.

Additional features and advantages of the invention will be set forth in the detailed description which follows, and in part will be readily apparent to those skilled in the art from the description or recognized by practicing the invention as described in the written description and claims hereof, as well as the appended drawings.

It is to be understood that both the foregoing general description and the following detailed description are merely exemplary of the invention, and are intended to provide an overview or framework to understanding the nature and character of the invention as it is claimed.

The accompanying drawings are included to provide a further understanding of the invention, and are incorporated in and constitute a part of this specification. The drawings illustrate one or more embodiment(s) of the invention, and together with the description serve to explain the principles and operation of the invention.

BRIEF DESCRIPTION OF THE DRAWINGS

The invention is further illustrated with reference to the following drawings in which.

DETAILED DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
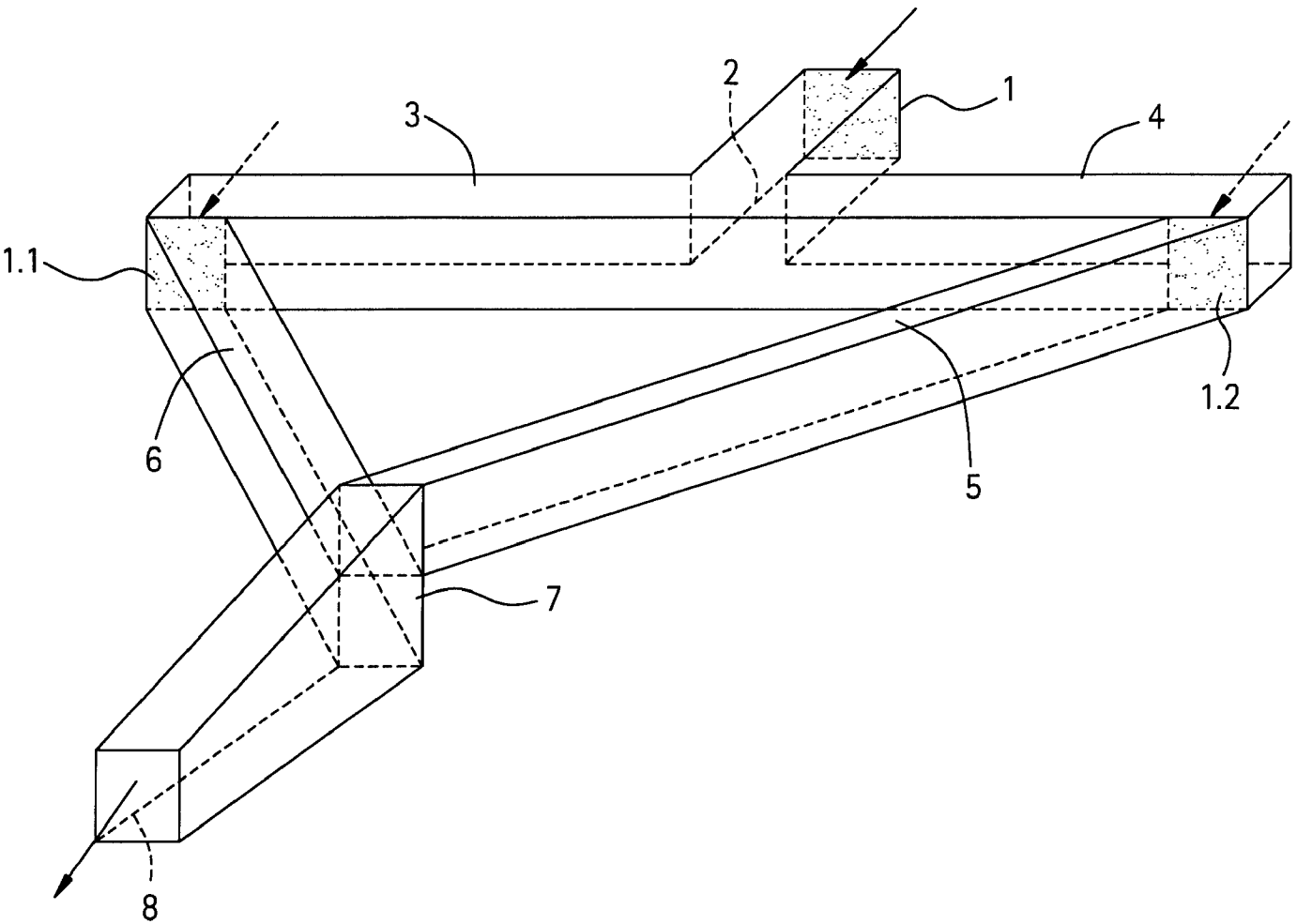
FIG. 1 PRIOR ART
FIG. 1 is an example of a prior art split and recombine mixer.
Figure 2:
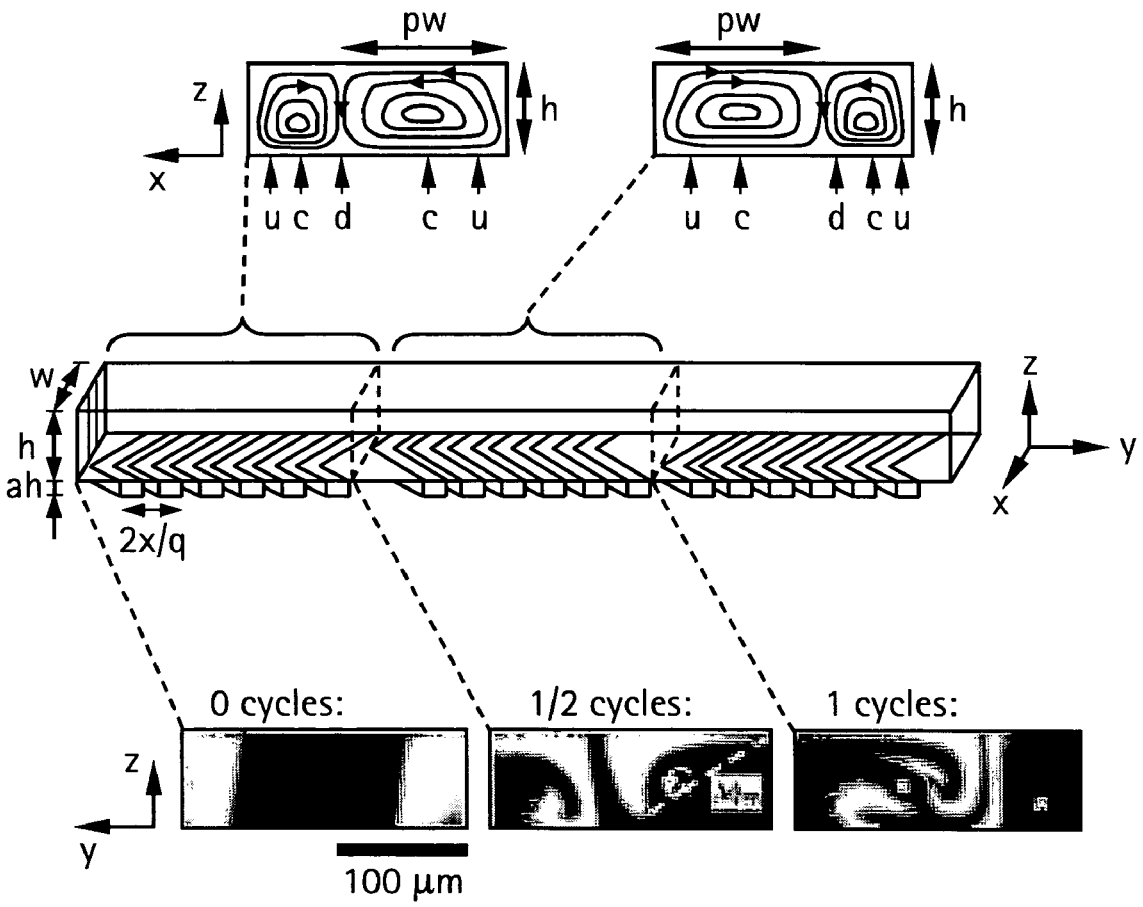
FIG. 2 PRIOR ART
FIG. 2 is an example of a prior art chaotropic mixer.
Figure 3:
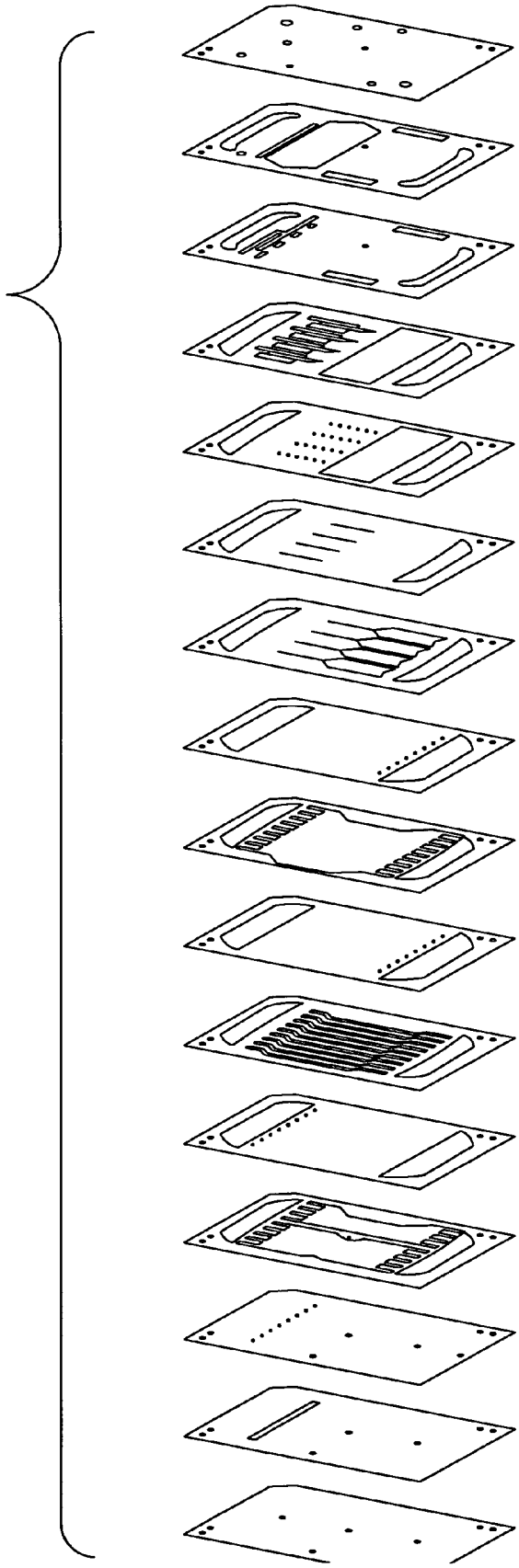
FIG. 3 PRIOR ART
FIG. 3 is an example of a prior art slug and decompression mixer.
Figure 4:
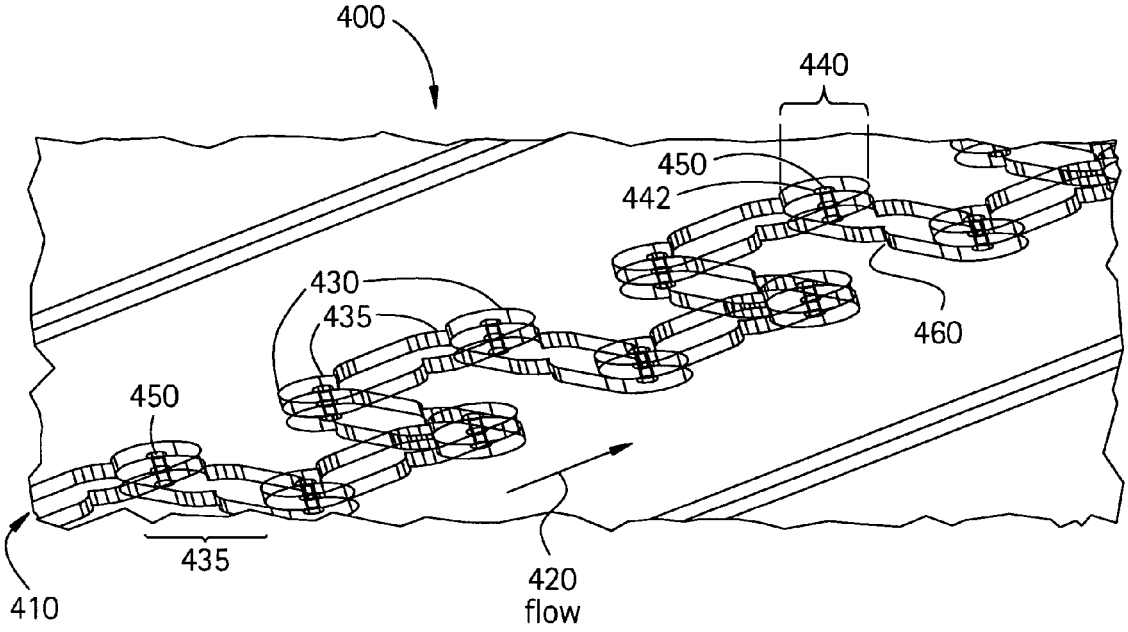
FIG. 4 is a three-dimensional schematic view of a mixer in accordance with a preferred embodiment of the present invention.

Referring to FIG. 4, a three-dimensional view of mixer 400 is shown in accordance with a preferred embodiment of the present invention to include an injection zone 410 where two or more fluids or reactants (not shown) would make initial contact and flow upstream as indicated at arrow 420. Forming a somewhat snake-like shape, a series of mixer elements 430 are shown to include: 1.) fairly rectangular channel segments 435 (with slightly rounded corners); and 2.) a chamber 440 at each end of the channel segment, with an obstacle 450 positioned inside of the chamber in accordance with a preferred embodiment of the present invention of the mixer 400. In accordance with another aspect of the preferred embodiment of the present invention, the obstacle 450 is a cylindrical pillar or post placed within chamber 440, thereby reducing the inner dimension 442 of the chamber 440.

Additionally, in an alternate preferred embodiment of the present invention, a restriction 460 that is dimple-like may be present on one or both sides of segment 435. In a still further alternative preferred embodiment, an injection-mixing-injection layout (not shown) is provided where additional fluid-mixing is accomplished further downstream.

In accordance with the preferred embodiment of the present invention, the obstacle 450 dimension ranges include: a radius or related dimension of 50 μm to 4000 μm and a height of 100 μm to 5000 μm.

Channel segment 435 ranges include: a radius of 100 μm to 5000 μm, height of 100 μm to 5000 μm, a width of 100 μm to 10000 μm, and a length of 200 μm to 10000 μm in accordance with the preferred embodiment of the present invention.

Restriction 460 dimension ranges include: a width of 50 μm to 2500 μm and a height of 100 μm to 5000 μm in accordance with the preferred embodiment of the present invention.

The inner dimension of the chamber 442 in the presence of the obstacle 450 has a radius in the range of 100 μm to 5000 μm, with a perimeter ranging from 600 μm to 30 mm, a surface from 3 $mm^2$ to 80 $mm^2$, and a volume from 0.3 $mm^3$ to 120 $mm^3$ (with heights between 100 μm and 5000 μm) in accordance with the preferred embodiment of the present invention.

It is generally desirable to reduce this inner dimension so that the length over which the reaction occurs (for the diffusion process) is reduced. Though not shown, it is contemplated that there may be more than one obstacle 450 in each chamber 440 if desired efficiency is achieved. Furthermore, in the preferred embodiment of a series of mixer elements 430, solid particles, if present, in the fluid flow stream will aptly flow through the mixer elements. Designs using reduced dimensions after parallelization (e.g. where the reactant stream is split into one upstream channel and multiple downstream channels) typically have additional problems with solid particle flow thereby decreasing the efficiency of the mixer.

Figure 5:
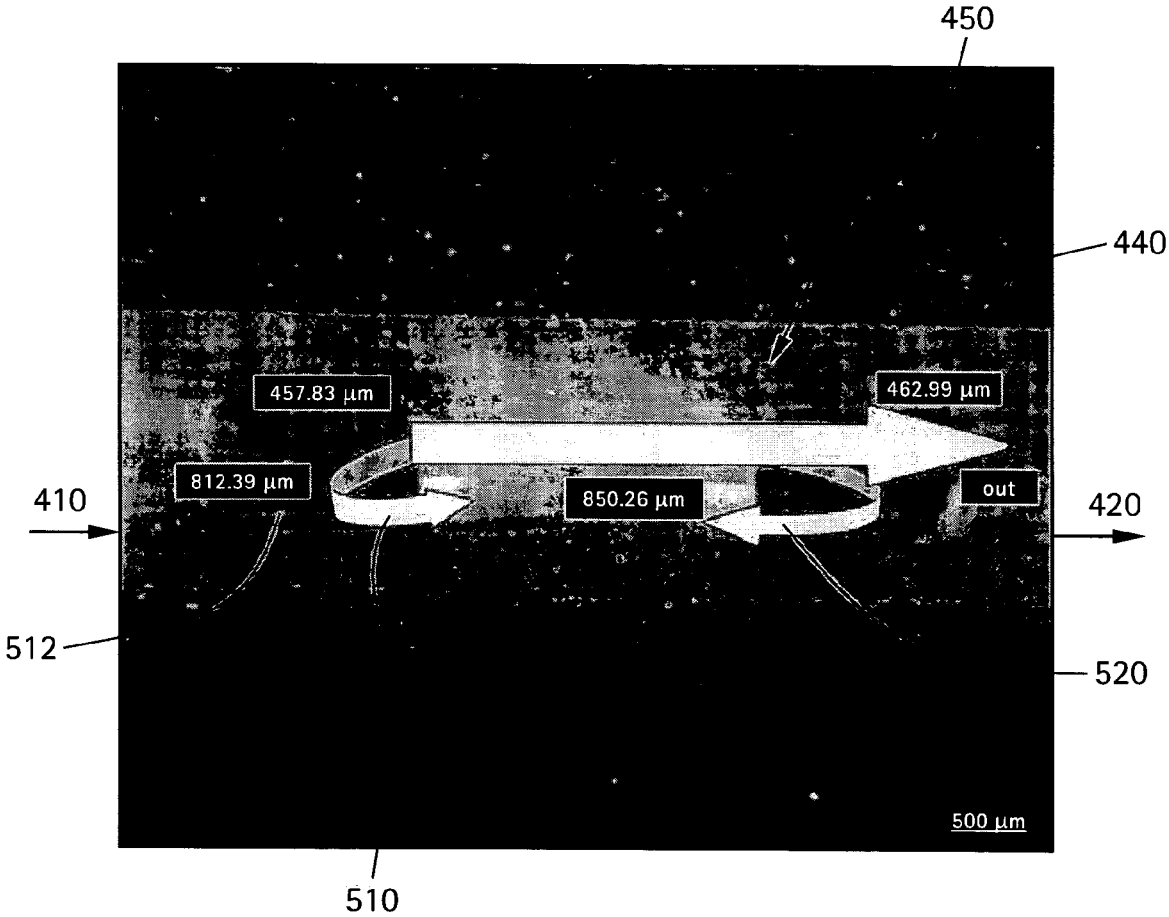
FIG. 5 is a cross-sectional view of FIG. 4 in the center of a mixer post in accordance with a preferred embodiment of the present invention.

FIG. 5 shows a cross-section view of an obstacle 450, shown as a pillar in FIG. 4, in accordance with the present invention. The pillar 450 creates a tortuous path for the liquids or reactants to flow through, thereby creating adequate flow which may include accelerating the flow of the liquids or reactants locally, due to reduced inner dimensions. FIG. 5 depicts this tortuous flow within the cavity 512 of chamber 440 via arrows 510 and 520.

Even though the flow remains typically laminar, there is a significantly higher velocity in the restriction in and around the pillars 450 to generate mixing. For the structure in FIG. 5, the Reynolds numbers (water-20° C.) can range from 20 to 2000 respectively, for liquid flow rates ranging from 1 ml/min to 100 ml/min respectively.

Mixing is generated in this preferred embodiment of the present invention for at least three apparent reasons: 1.) flow is unstable after a cylinder at Reynolds number higher than approximately 20, covering the range of flow rates of the present invention. It should be noted that while there is no precise value for such a complex geometry, the order of magnitude is between 50 & 500; 2.) the tortuous flow path allows inertia to play a role and adequately mix the fluid; and 3.) reduction of the thickness of the reactant fluid by reduction of the internal dimensions of the channels through which the fluid is circulating, which has the effect of reducing length over which diffusion has to occur, thereby reducing characteristic time needed for diffusion.

Many other mixer element embodiments are contemplated by the present invention whose results would practically be the same and where the shape of the various mixer elements structures would be a design choice for enhancing the capability of mixing. While cylinder shaped pillars are described as being the preferred embodiment for the obstacle 450 in FIG. 4, any other geometrical shape (triangular, rhombus, diamond, etc.) within the realm of possibility, with or without grooves or other delineations on its surface, are envisioned falling within the scope of this invention. It is also contemplated that not all obstacles 450 within one mixer 400 necessarily have the same geometry. They may, for a particular mixer design, require all different shapes and sizes, be alternating and/or populate the segments in whatever manner suits the proper and desired mixing. Furthermore, the shape of the channel segment 435 is not limited to the more or less rectangular shape with rounded corners depicted in FIG. 4 (and respective cross-section in FIG. 5); other shapes for the segment 435 are also contemplated by the instant invention to be used by a person of ordinary skill in the art, yet still fall within the scope of the present invention. Similarly, alternate shapes are also contemplated for the restriction 460 besides dimple-like. As such, the cross-section shown in FIG. 5 will vary depending of course on the different shapes of the mixer elements of FIG. 4. Furthermore, the number of mixer elements placed in series can range anywhere from one to whatever minimum number of elements produces the desired mixing efficiency. In many instances, the addition of more mixer elements will not necessarily increase the mixing efficiency. Additionally, as mentioned supra, and as shown infra in FIGS. 7*a* and 7*b* for example, the dimensions of each of the mixer elements can also have a varying range, depending on desired mixing efficiency in accordance with novel aspects of the present invention.

In an alternate preferred embodiment of the present invention, the combination of a continuous, localized flow path may position the pillars or cylindrical posts 450 (or other types of obstacles) in the middle of the channel segment 435 or anywhere else rather than at the ends of the channel within the chamber 440 with or without restrictions 460 and still create desirable mixing and appropriate flow or acceleration of liquids flowing through the path. Furthermore, in yet another alternative preferred embodiment of the present invention, there is a novel control of the injection zone and the interface zone or contacting region where fluids interact for the first time. This latter control is described in some further detail infra with respect to FIGS. 6*a*, 6*b*, and FIGS. 8 and 8*a*.

It should be emphasized that in all the preferred embodiments described herein, the pressure drop created by the actual mixer structure and the mixing quality can be adjusted to a desired balance by one of ordinary skill in the art to achieve optimum performance by changing the design dimensions accordingly.

Mixing typically occurs in the 'x-y' plane, and as such, dimensional changes in the horizontal plane usually affect mixing quality. Height is a dimension in the vertical 'z' plane and typically has a first order impact on pressure drop and a second order impact on mixing quality, the latter being impacted more by the mixer elements 430 described supra.

Figure 6A:
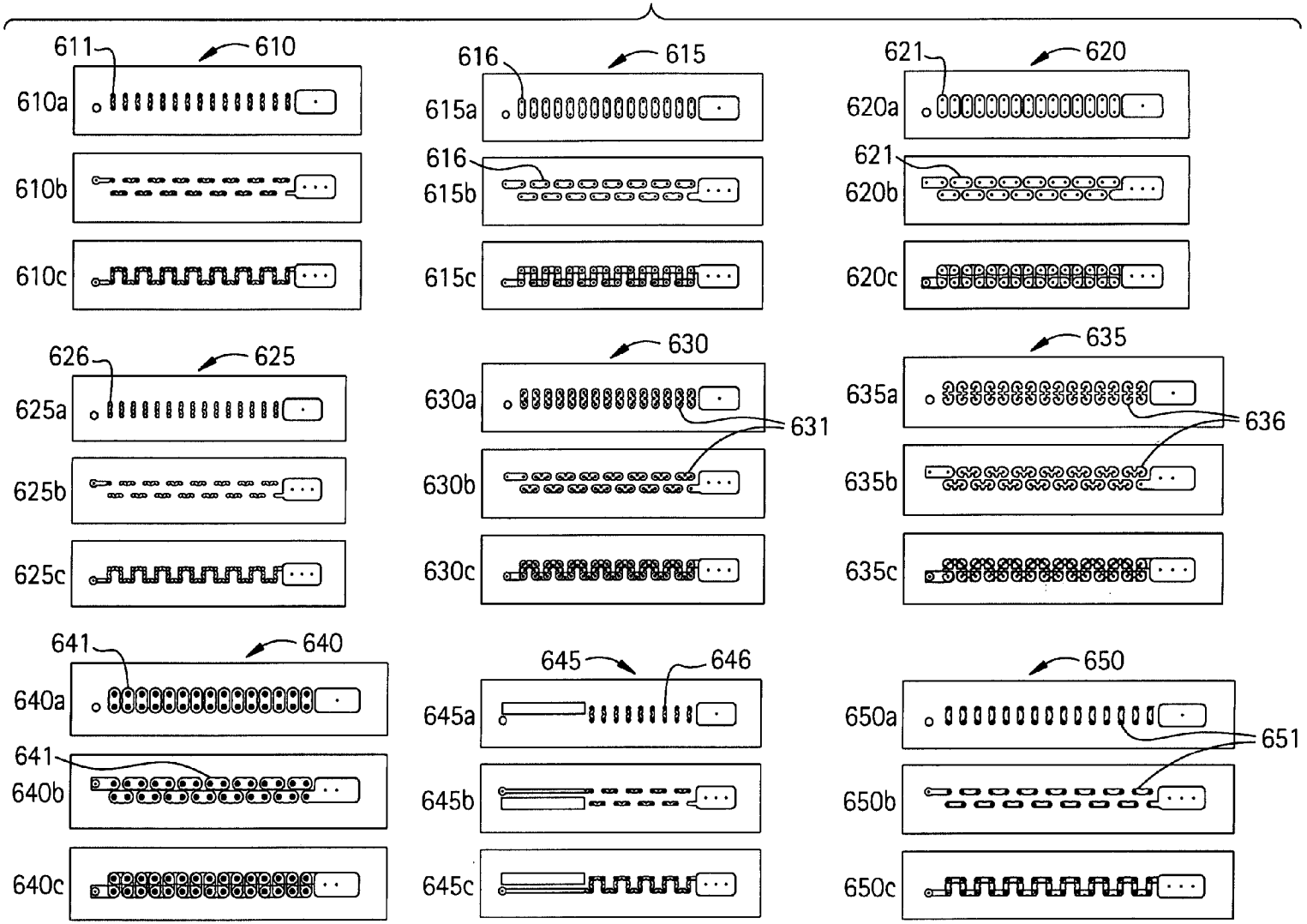
FIGS. 6*a* and 6*b* are top views of layers of the mixer design in accordance with a preferred embodiment of the present invention.
Figure 6B:
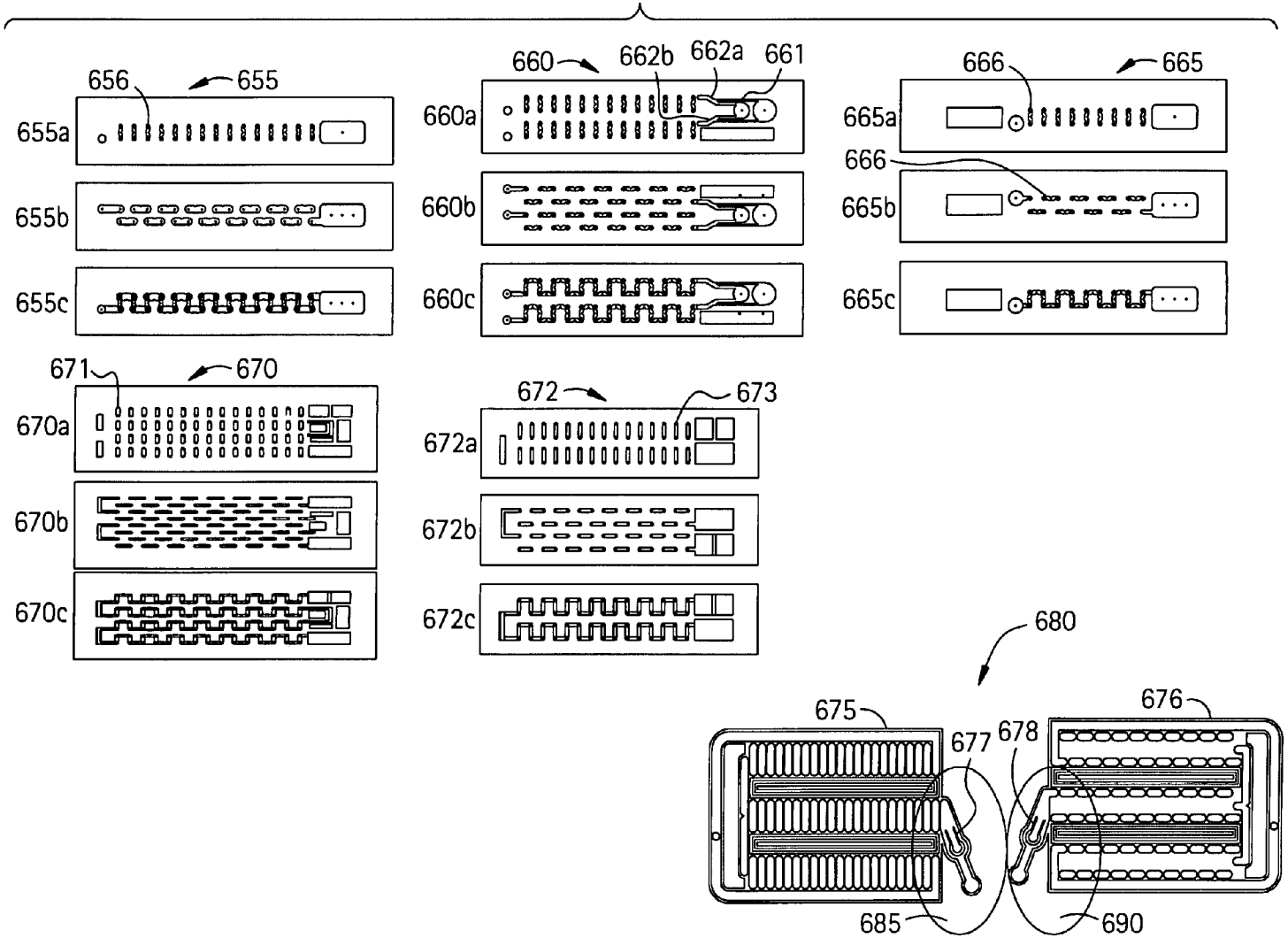

Referring now to FIGS. 6*a* and 6*b*, several preferred design structures 610 through 680 for mixer 400 are shown that fall within the scope of the present invention's mixer principles. Each layer of mixer 400 is displayed by three rectangular shapes; for example, 610*a* and 610*b* signify the top and bottom layers of mixer elements, respectively, while 610*c* represents the final assembled structure of one single microstucture mixer produced by the top layer 610*a* being assembled over the bottom layer 610*b* in accordance with the preferred embodiment of the present invention. As may be seen in the FIGS. 6*a* and 6*b*, the channel segments lie in one of two layers, such as layers 612*a* and 610*b*. The channel segments in one layer, such as 610*a*, extend in a first direction and the channel segments in the other layer, such as 610*b*, extend in a second direction perpendicular to the first direction. The layers shown in FIGS. 6*a* and 6*b* are preferably made of glass, ceramic or glass-ceramic substrate materials. Each mixer design is preferably formed on a wafer.

This top, bottom and assembled 3-layer scheme is representative of all the mixers shown in FIGS. 6*a* and 6*b*, except for mixer 680 where only top and bottom layers, at 675 and 680 respectively, are shown.

As stated above, in the preferred embodiments of the present invention, fabrication occurs by having two layers come together to form a third assembled layer. For other design embodiments, however, it is possible to have one micro-patterned layer coming together with a bare or a coated glass, ceramic, or glass-ceramic substrate.

In preferred embodiments 610, 615, 620, 625, 630, 635, 640, 645, 650, 655, 665, 670, and 672 (representing the majority of embodiments shown in FIGS. 6*a* and 6*b*), the structures depict the mixer elements structured in series. Putting two series of mixer elements in parallel (shown in FIG. 6*b* at 660 and 680), while also possible with the same design principle, may not be as desirable due to the potential deviation of the ratio between the flow rates of the fluids or reactants (from its value at the inlet) in each branch 662*a* and 662*b*. In this embodiment at 660, the mixing efficiency is adequate in each branch 662*a* and 662*b*, but the stoechiometry cannot be conserved. However, this type of flow separation is a useful way to reduce the overall pressure drop.

Figure 10:
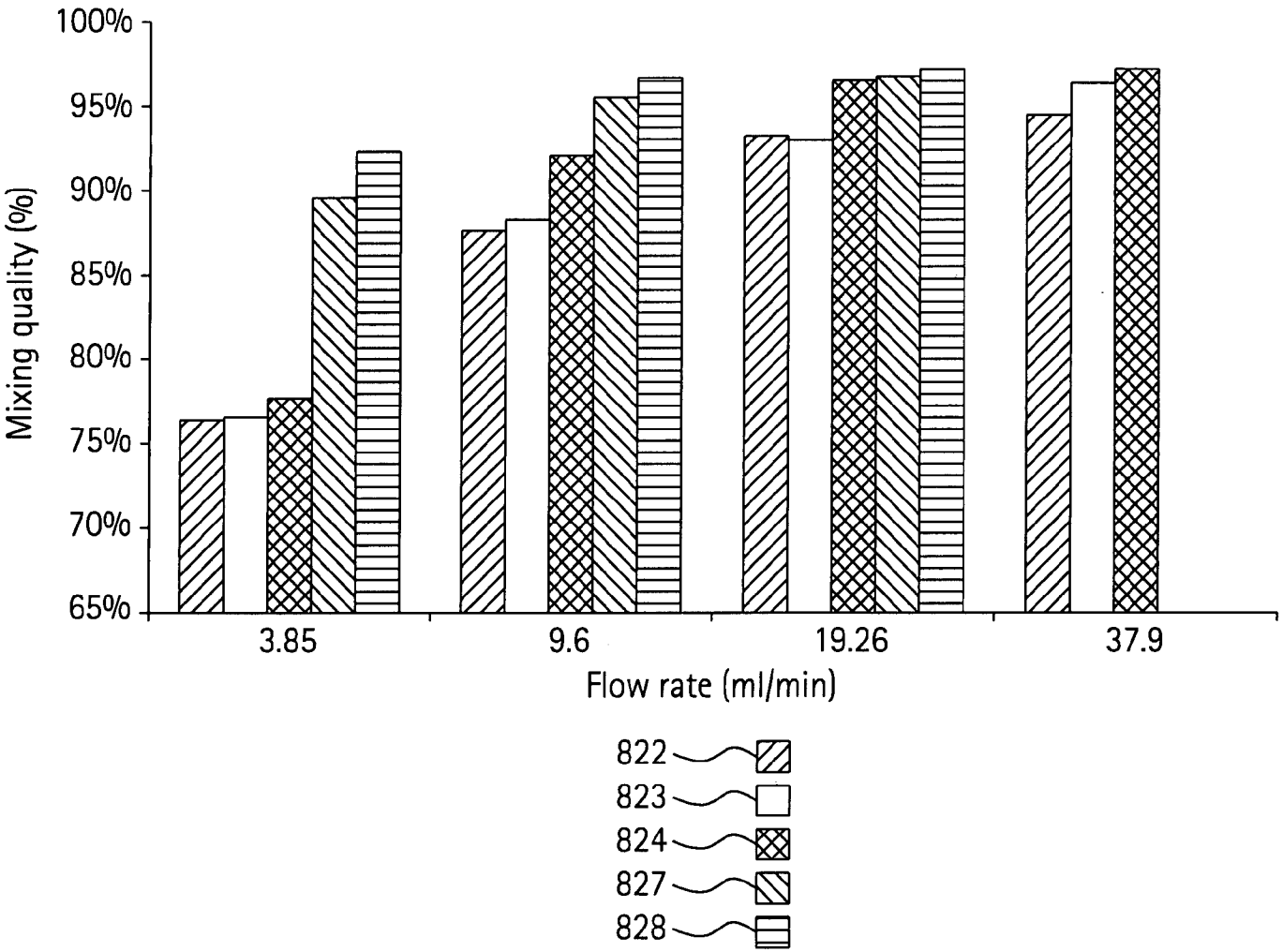
Figure 11:
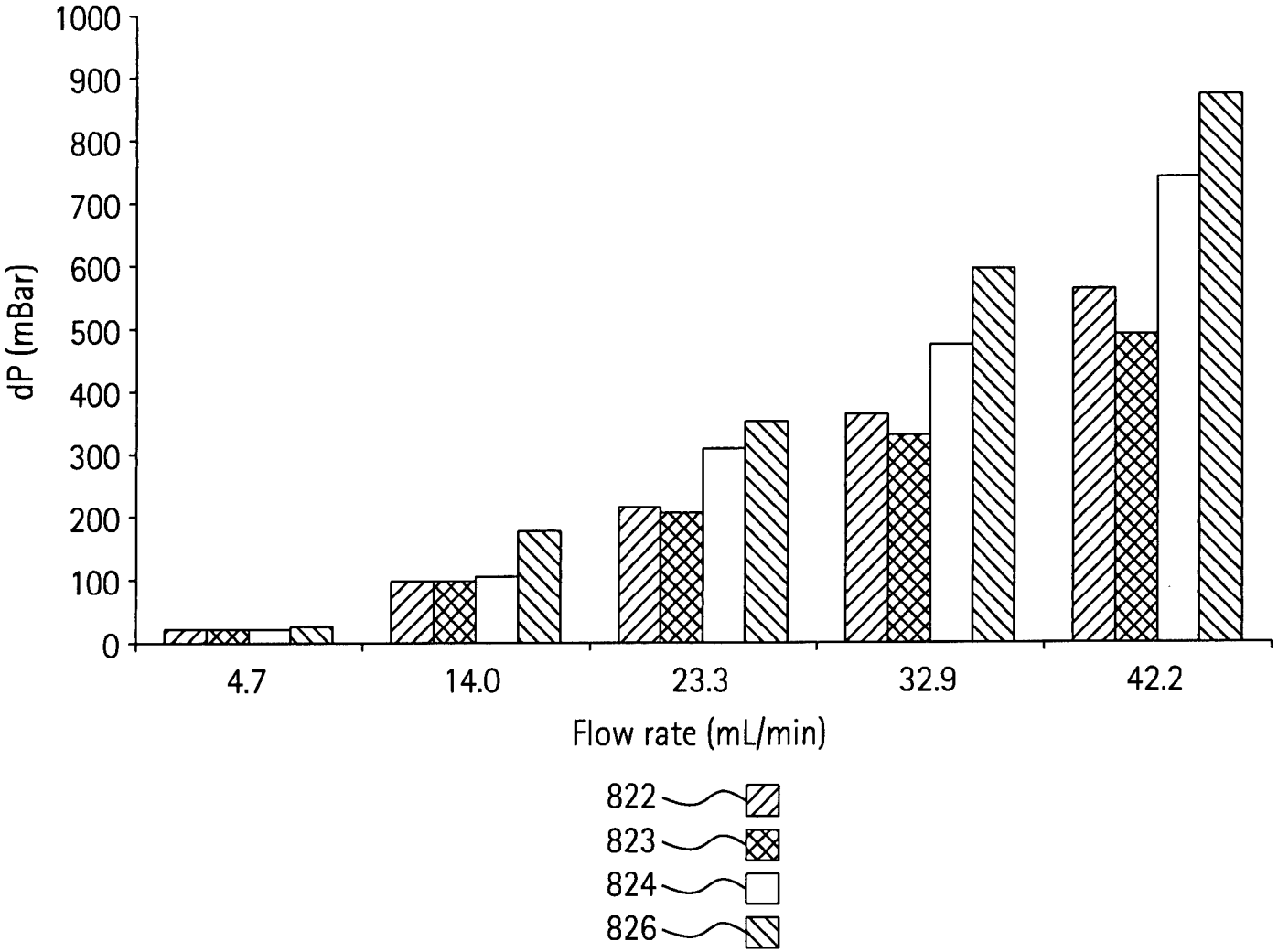

Many structural mixer design details are shown in the preferred mixer embodiments in FIGS. 6*a* and 6*b* to include variations in the number and size of mixer elements, the injection zone design and the restriction in the segments. Increasing the number of mixer elements will increase the pressure drop created by the mixer as is shown in plots of FIGS. 9-11 infra. This is shown to also increase the mixing completeness (or efficiency).

Referring now to mixer 680, the regions 685 and 690 at top and bottom layers 675 and 676 indicate the injector zone regions in accordance with a preferred embodiment of the present invention. These injection zones 685 and 690 have been modified to enhance mixing by creating two interfaces coming from the injector 685 and 690. The interfaces between the fluids are created by core fluids in the cores or central injection passages 677 and 678 when assembly of 675 and 676 takes place. These fluids are controlled at first interaction in accordance with a preferred embodiment of the present invention. Though in this embodiment, there are two interface with two fluids, depending on how many additional fluids, the number of interfaces between the fluids may increase. The injection zone, including interfaces and single or multiple cores, is further described infra with respect to FIGS. 8 and 8*a*.

Figure 7A:
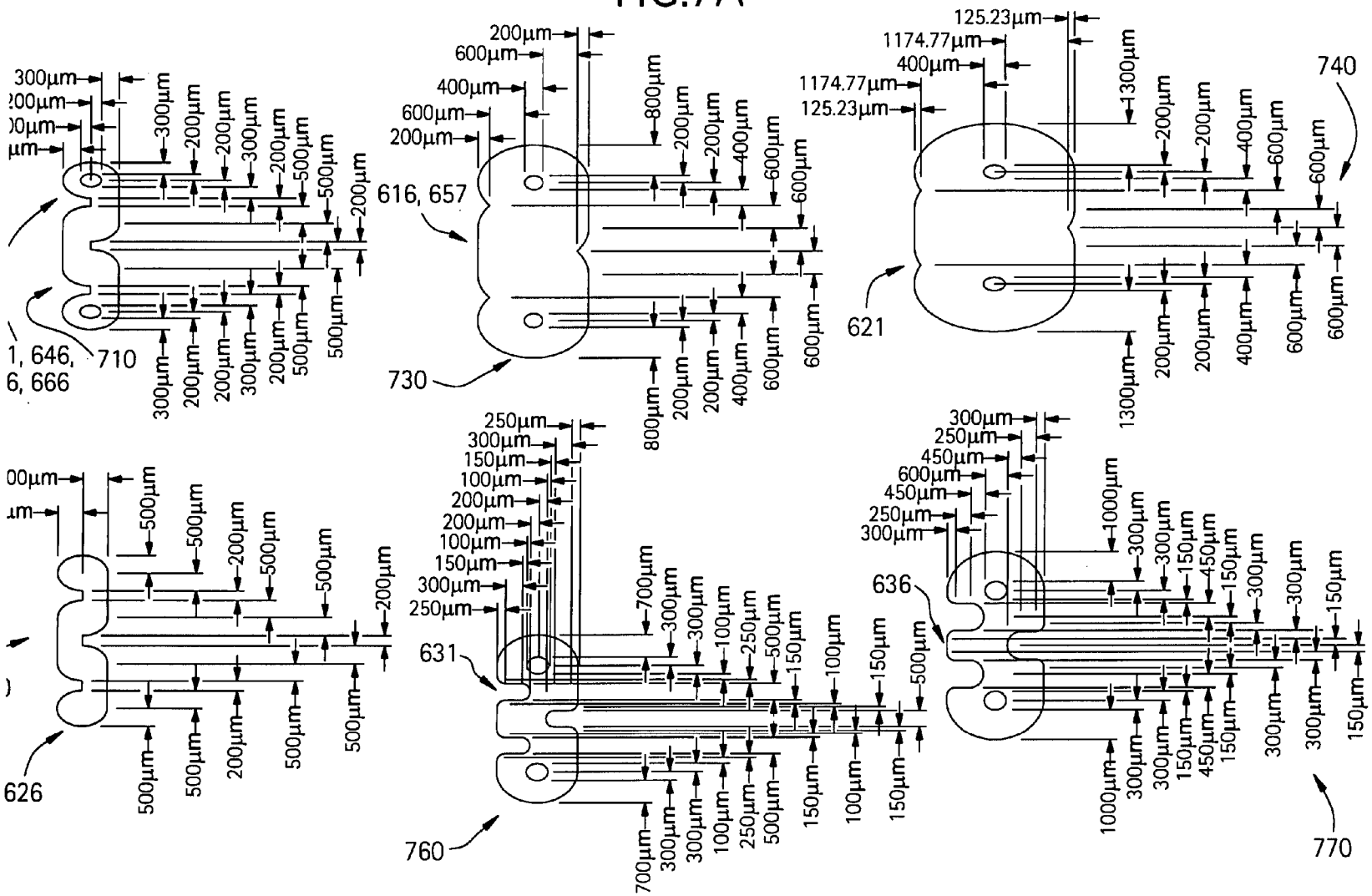
FIGS. 7*a* and 7*b* show typical dimensions of the mixer designs of FIGS. 6*a* and 6*b* in accordance with a preferred embodiment of the present invention.
Figure 7B:
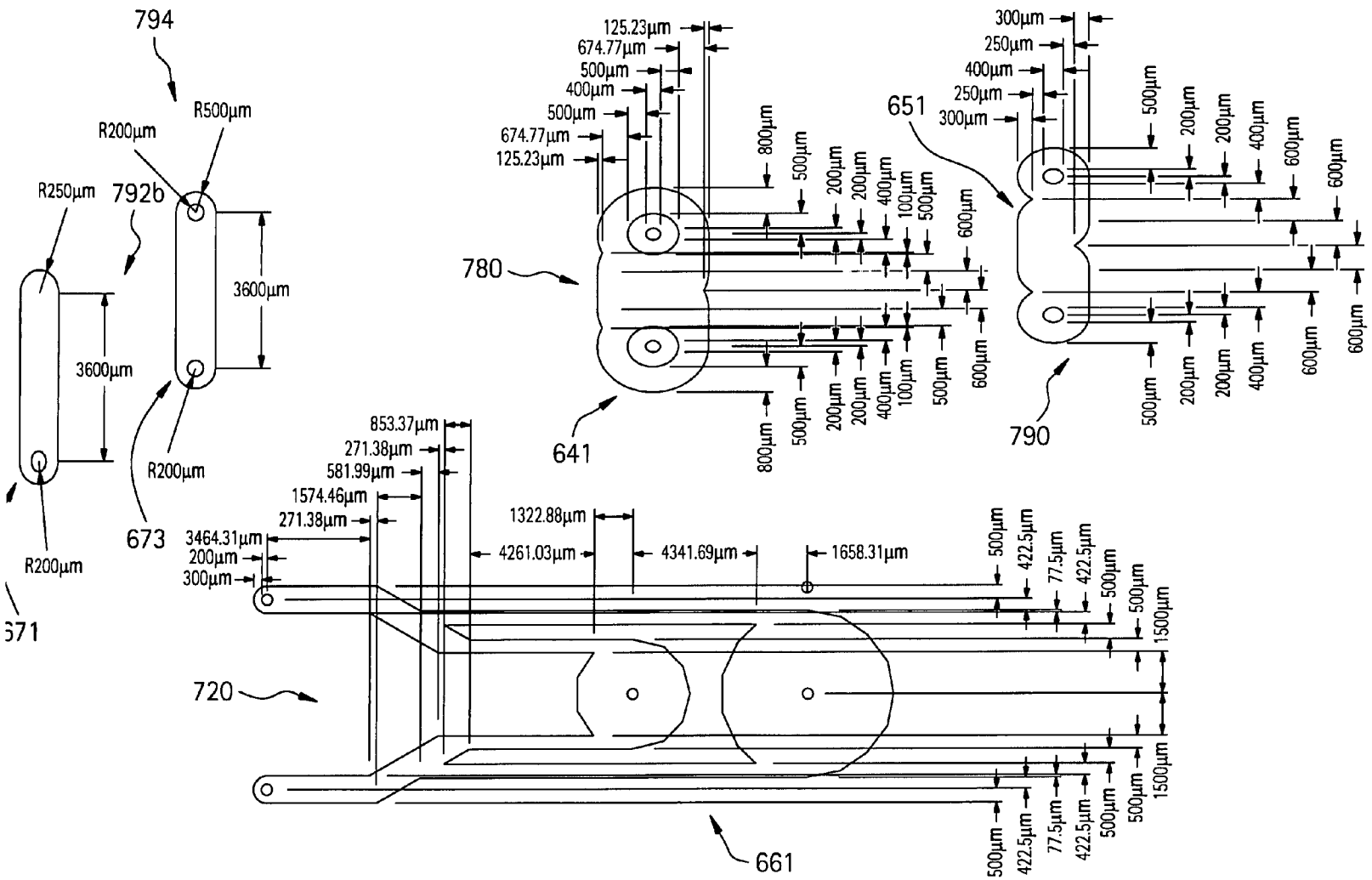

Referring now to FIGS. 7*a* and 7*b*, the corresponding preferred dimensions of the mixer elements used for fabrication of embodiments depicted in FIGS. 6*a* and 6*b* are shown in accordance with a preferred aspect of the present invention. For instance at 710, the data for dimensions such as radius, length, etc. of mixer elements 611, 646, 656 or 666 of FIGS. 6*a* and 6*b* are diagrammed, and so forth. At 720, the preferred dimensions of injection zone 661 of embodiment 660 of FIG. 6*b* are detailed. Furthermore at 730, the preferred dimensions of mixer elements 616 or 657 of FIGS. 6*a* and 6*b* are delineated; at 740 the preferred dimensions of mixer element 621 of FIG. 6*a* are set down; at 750 the preferred dimensions of mixer element 626 of FIG. 6*a* are defined; at 760 the preferred dimensions of mixer element 631 of FIG. 6*a* are shown; at 770 the preferred dimensions of mixer element 636 of FIG. 6*a* are set down; at 780 the preferred dimensions of mixer element 641 of FIG. 6*a* are defined; at 790 the preferred dimensions of mixer element 651 of FIG. 6*a* are defined; and at 792 and 794 the preferred dimensions of mixer elements 671 and 673 of FIG. 6*b* are defined.

A testing method used to quantify mixing quality of two miscible liquids is described in Villermaux J., et al. *Use of Parallel Competing Reactions to Characterize Micro Mixing Efficiency*, AIChE Symp. Ser. 88 (1991) 6, p. 286. A typical testing process would be to prepare, at room temperature, a solution of acid chloride and a solution of potassium acetate mixed with KI (Potassium Iodide). Both these fluids or reactants would be continuously injected by means of a syringe pump into a mixer or reactor (i.e. the one to be tested in terms of mixing). There would be a continuous fluid flowing out from the mixer through a flow thru cell or cuvette (10 μliters) where quantification is made by transmission measurement at 350 nm. Any extraneous fluids would be collected as waste.

Using this testing method at room temperature on the structures described herein, the quality of mixing for the present invention is ideal for a 100% value. Pressure drop data is acquired using water at 22° C. and peristaltic pumps. The total flow rate is measured at the outlet of the mixer or reactor 430 as shown in FIG. 4 using a pressure transducer by measuring the upstream absolute pressure value, where the outlet of the mixer 430 (or mixer embedded in a micro reactor system as shown infra) is open to atmospheric pressure.

Figure 8:
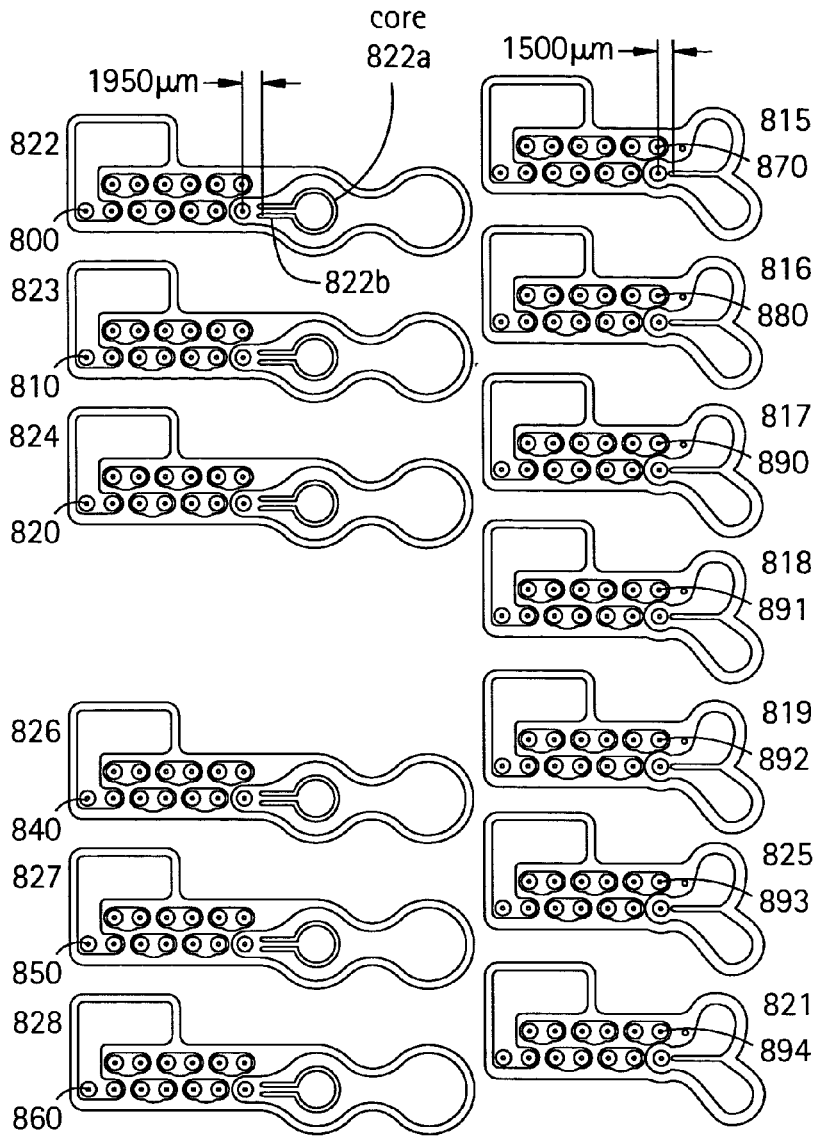
FIG. 8 is a top view of alternate mixer designs with increased dimensions in accordance with a preferred embodiment of the present invention.

FIG. 8 shows a group of mixers with radii ranging from 700 μm to 1300 μm in accordance with an alternative preferred embodiment of the present invention. It should be noted that the mixers described in FIGS. 6*a* and 6*b* and FIGS. 7*a* and 7*b* supra depicted designs with dimensions such that resulting pressure drop is reasonable and mixing efficiency is appropriate, whereas FIG. 8 depicts designs where there is an increase in dimensions, in particular the radius of the obstacle, to show an increase in mixing efficiency and an increase in pressure drop. In FIG. 8, core element 822*a* acts as a control of the contacting regions where fluids interact for the first time. Mixers 822, 823, 824, 826, 827, and 828 also have cores (not labeled) but the remaining mixers in FIG. 8 do not illustrate this core feature.

Figure 8A:
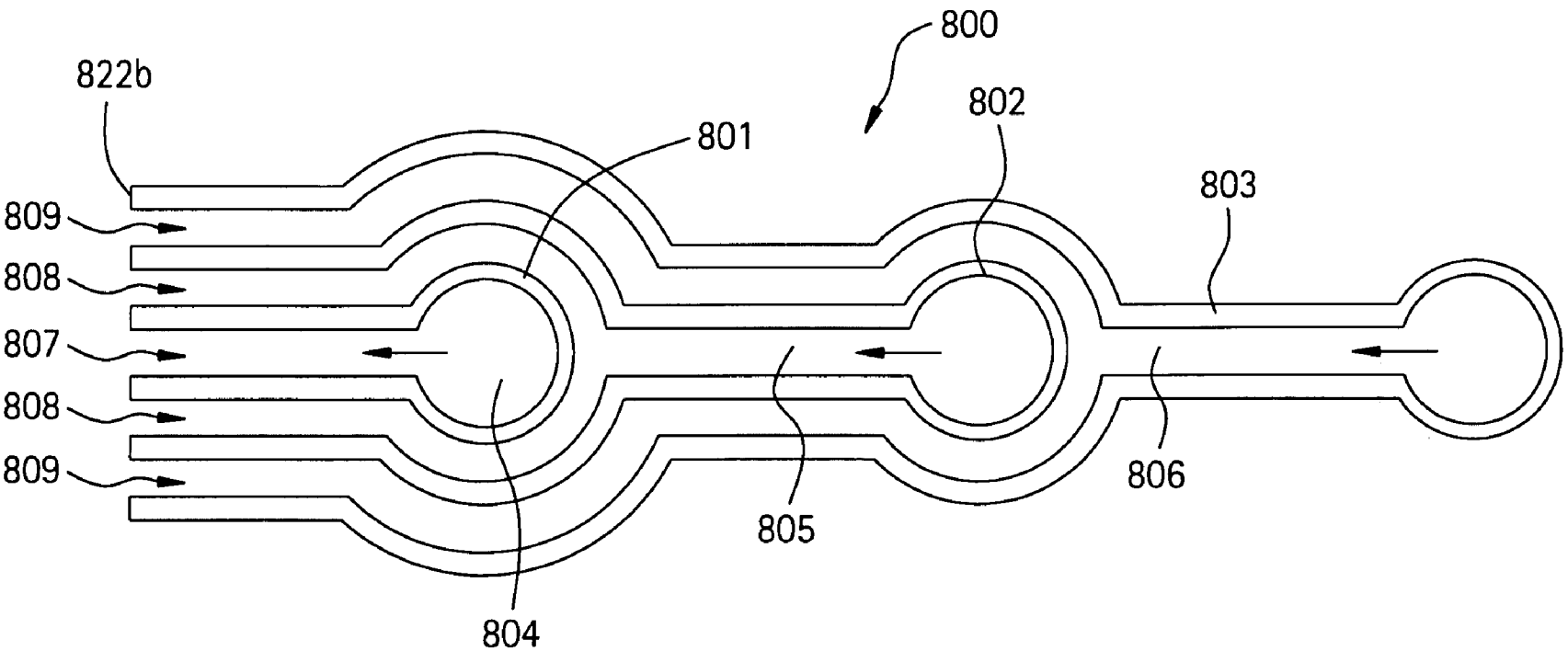
FIG. 8*a* shows a multiple core injection zone in accordance with an alternate preferred embodiment of the present invention.

Referring to FIG. 8*a*, a multiple core injection zone design 800 is shown having two cores or central injection passages, 801 and 802, one inside the other, in an alternative preferred embodiment of the present invention. Fluids flow from right to left, as shown by directional arrows in FIG. 8*a*. Core fluid 804 flows from right to left within core 801 towards and through interface zone 807. Core fluid 805 flows right to left within the boundary of core 801 and core 802 towards and through interface zone 808. Core fluid 806 flows right to left within annular fluid region 803 and core 802 towards interface zone 809.

The core fluids 801, 802, and 803 are kept separated until they reach the entrance zone 822*b* of the mixer 822 (shown in FIG. 8). The distance from the entrance zone 822*b* and the first mixer element 800 in the path will typically be 1950 μm as shown in the single core injection zone design of FIG. 8. The embodiments shown in FIGS. 8 and 8*a* effectively control the core fluids by preventing contact between them until they are extremely close to the mixer, where the fluids then interface, enter and mix.

Figure 9:
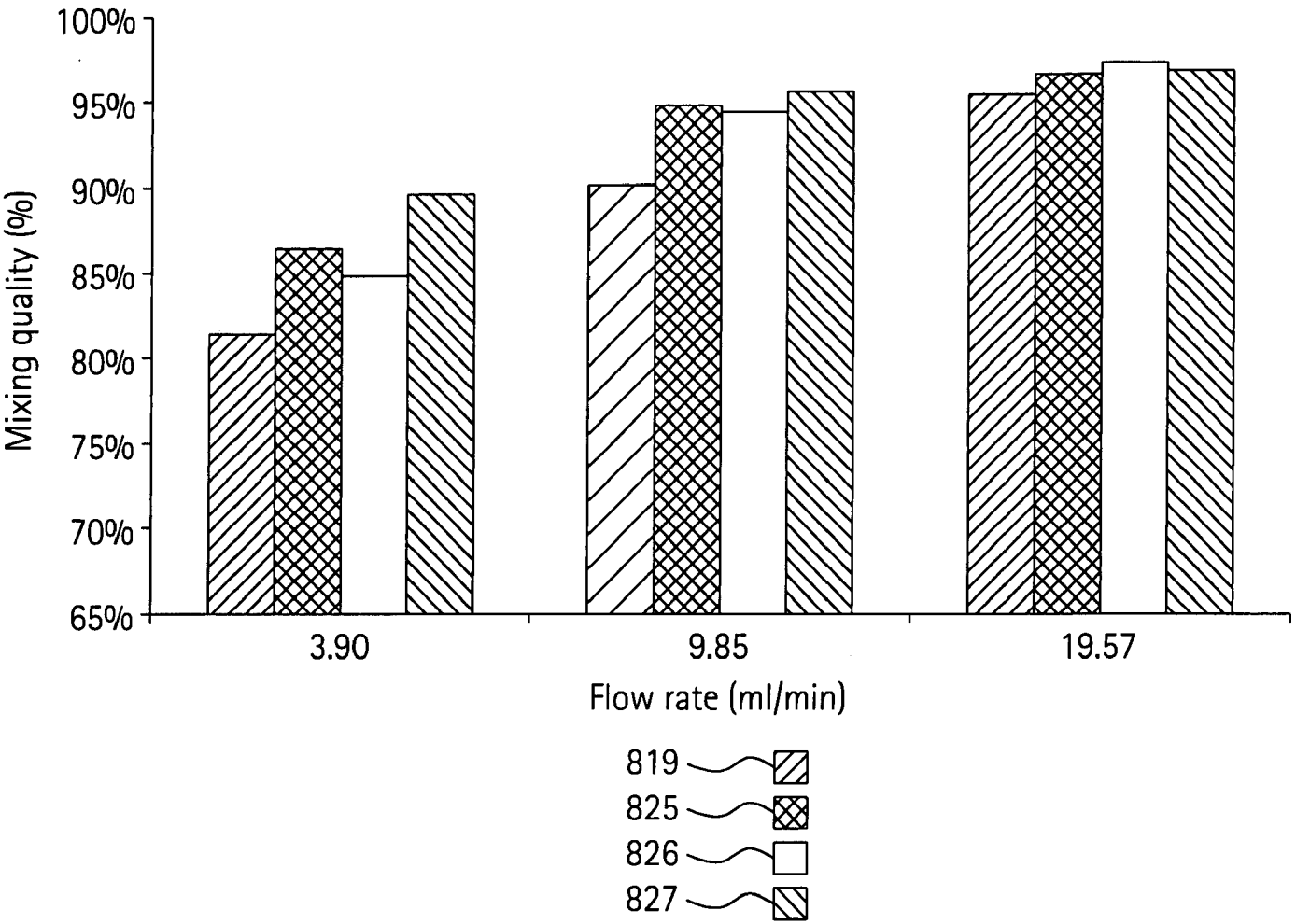
FIGS. 9-11 are plots of pressure drop and mixing quality of various mixer designs of FIG. 8 having varying dimensions in accordance with a preferred embodiment of the present invention.

FIG. 9 shows a graph of the comparison of different designs of FIG. 8 clearly depicting the pressure drop vs. mixing efficiency relationship in accordance with an alternate embodiment of the present invention. It can be seen that increasing the pressure drop of the various mixer design structures of FIG. 8 shows a corresponding increase in mixing efficiency. Similarly, in FIG. 10, a plot illustrates the increase in mixing quality (upwards of 90%) for a mixer with an obstacle radius of 1200 μm (as in mixer 827 of FIG. 8)—1300 μm (as in mixer 828 of FIG. 8). Additionally, FIG. 11's plot shows the relative increase in pressure drop as the radius of the obstacle is increased.

Figure 12:
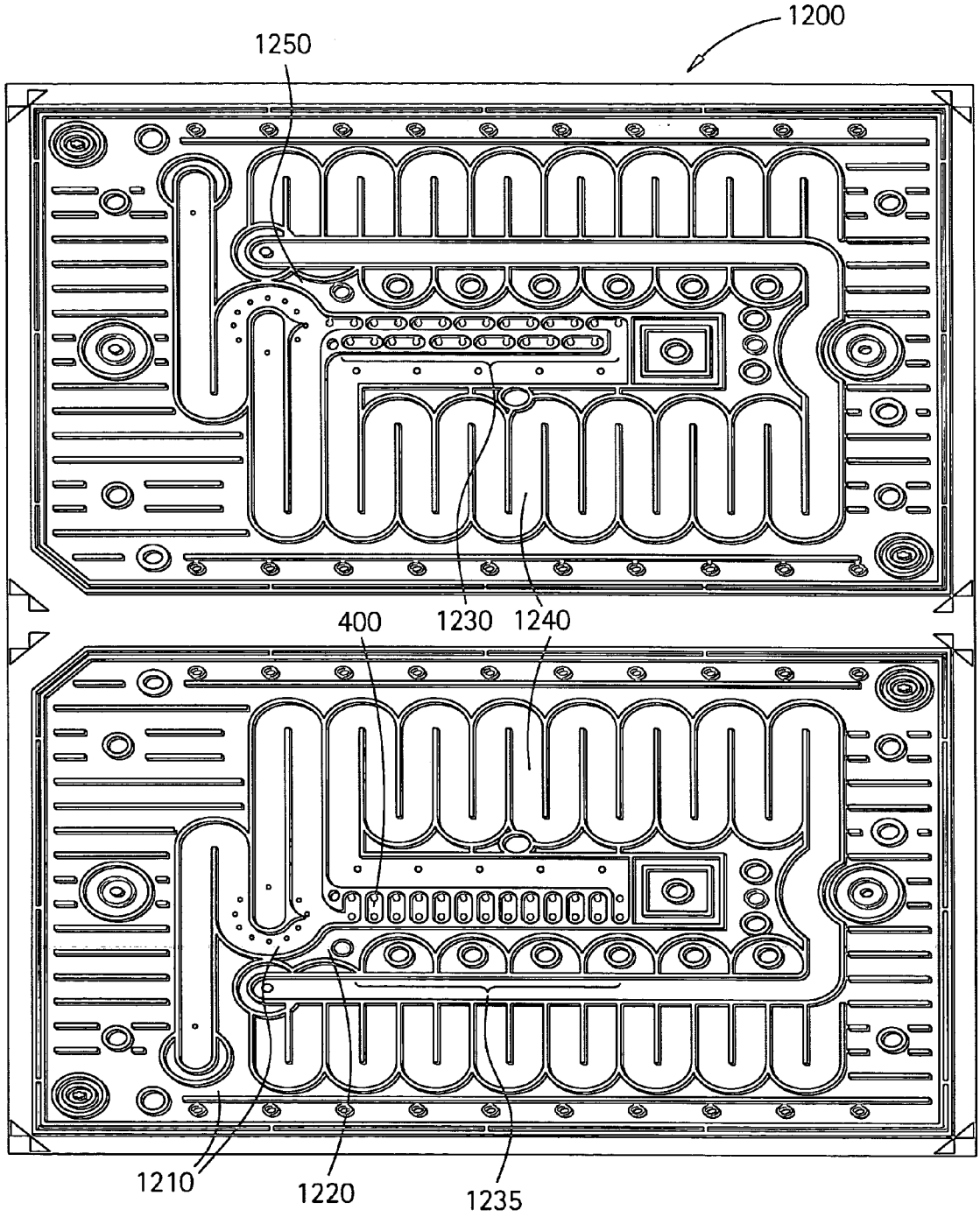
FIG. 12 shows a top view of a mixer embedded in a mixer reactor structure in accordance with a preferred embodiment of the present invention.

FIG. 12 depicts a three-dimensional split view of the mixer 400 of FIG. 4 in a reactor structure 1200. In accordance with the present invention, inlets 1210 are shown where fluids are initially introduced to reactor structure 1200 and flow through to a contacting zone 1220. The top and bottom areas 1230 and 1235 of the mixer 400 are also depicted. A dwell time zone or area 1240 is shown that allows the fluid a certain residence time in the micro channels based on the desired flow rate before it flows out of outlet 1250.

It is contemplated that mixer design 1200 layers may be combined with heat exchange layers (not shown) within a micro reactor to provide appropriate thermal conditions of the reactant fluids in accordance with a still further aspect of the preferred embodiment of the present invention.

Figure 13:
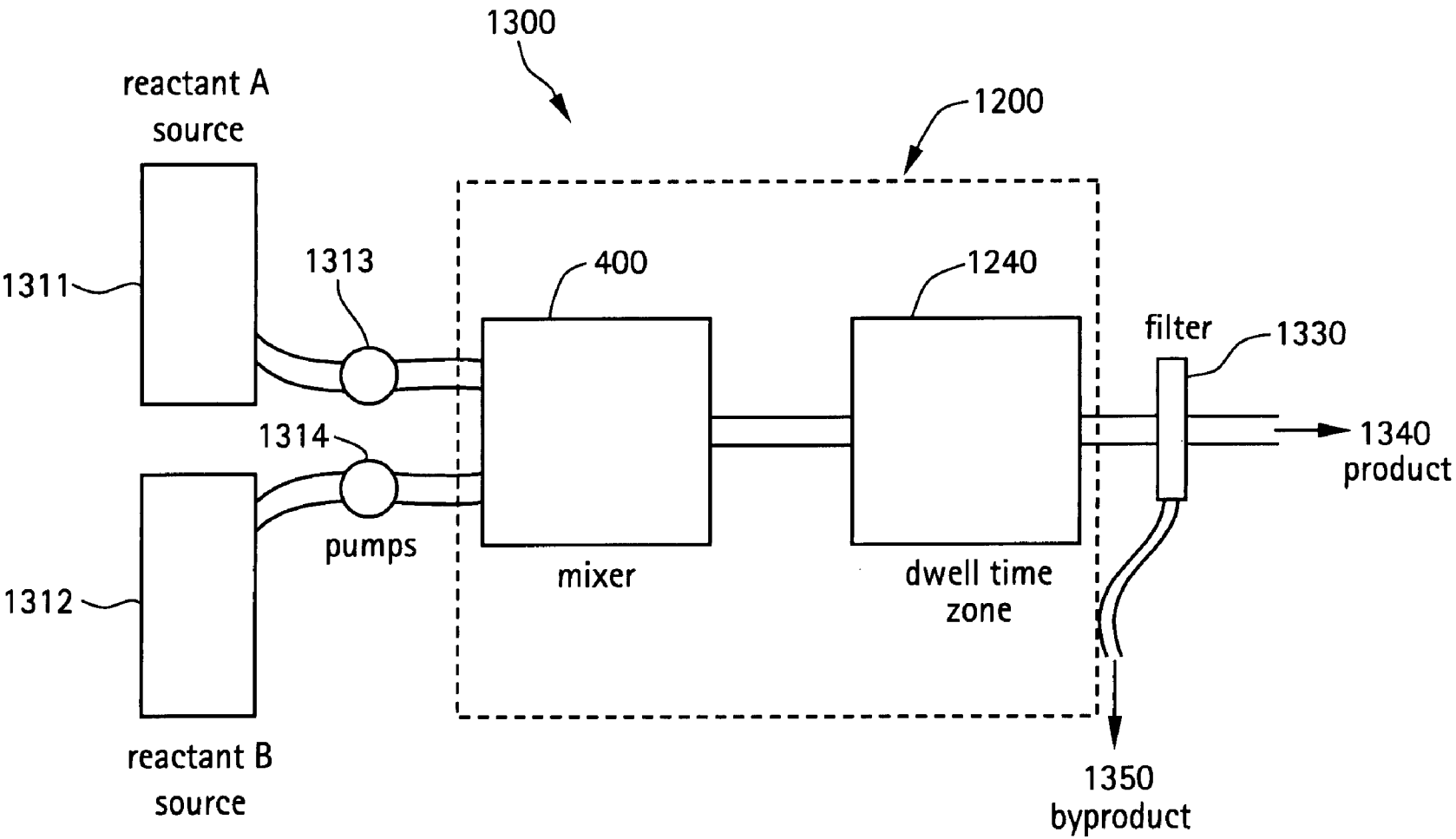
FIG. 13 shows a block diagram of the mixer of FIG. 12 in a micro reactor system in accordance with a preferred embodiment of the present invention.

Referring now to FIG. 13, a block diagram of a mixer device 1310 is shown situated within a micro reactor system 1300 in accordance with the present invention. The mixer 1310 and dwell time zone 1320 represent structure 1200, described supra in FIG. 12. Mixer 1310 has a source of reactants, 1311 and 1312 and two pumps 1313 and 1314. Dwell time zone 1320 is a micro fluidic device that typically has a single passage that allows the fluid a certain residence time in the micro channels based on the desired flow rate. A filter 1330 positioned at the output of the dwell time module 1320 can produce products 1340 and by products 1350.

It should be noted that all figures described supra are not of actual size but represent accurate renditions and structural block diagrams of the preferred embodiments of the present invention.

Several commercial applications are contemplated for use with the embodiments of the present invention such as, but not limited to, for instance, applications involving mixing both aqueous and organic liquids where these liquids are miscible and immiscible and applications mixing a reactive gas with a liquid, substituting one liquid reactant by inert or reactive gas. Furthermore, liquids can be constituted of a solid that has been dissolved in appropriate solvent, or dispersed in a liquid as mentioned supra. Some non-limiting examples of such liquids include:

1.) Homogeneous Gas Phase Reactions:

Hydrocarbon (gas or vapor) can be mixed with air in order to then be reacted in a catalytic zone for selective oxidation reactions (propylene to generate acroleine, butane to generate maleic anhydride). Hydrocarbons (gas or vapor) can be mixed with halogenated compounds to be reacted and generate halogenated hydrocarbons (benzene with chlorine).

2.) Homogeneous Liquid Phase Reactions:

Aldehydes/ketones in water can be mixed with sodium hydroxide aqueous solution in order to be reacted and generate aldol condensation products (propionaldehyde, acetaldehyde, acetone). Phenol in water can be mixed with nitric acid aqueous solution in order to be reacted and generate nitration products.

3.) Heterogeneous Liquid Phase Reactions:

Liquid hydrocarbons can be mixed with mixtures of sulfuric acid and nitric acid in order to be reacted and generate nitration products (toluene, naphthalene, etc. . . . ). Hydrogen peroxide can be mixed with liquid hydrocarbons to generate selective oxidation products (phenol oxidation to hydroquinone, catechol)

4.) Heterogeneous Gas/Liquid Reactions:

Gas can be mixed with liquids in order to be dissolved and then trapped (SO2 in sodium hydroxide aqueous solutions) or reacted (SO3 in sulfuric acid to generate oleum and then operate sulfonation reactions). Ozone (air, oxygen) in hydrocarbon solutions to then operate selective oxidation reactions whether they are homogeneous catalytic reactions (cyclohexane or paraxylene oxidations) or heterogeneous catalytic reactions (phenol, cumene).

Additionally, this latter solution can be used when a reaction has one or more of the products which is a solid being mixed and reacted with amine and acylchloride hydrocarbons in the presence of a tertiary amine solvent. This yields corresponding amides and quaternary ammonium salt which is insoluble in the mixture.

Having described various preferred embodiments of the present invention, it will be apparent to those skilled in the art that various modifications and variations can be made to the present invention without departing from the spirit and scope of the invention. Thus, it is intended that the present invention covers the modifications and variations of this invention provided they come within the scope of the appended claims and their equivalents.

The invention claimed is:

1. A mixer apparatus, said apparatus comprising: at least one injection zone in a continuous flow path where a plurality of fluids make initial contact, the injection zone comprising at least one co-axial injection passage positioned within said flow path having an entry outside the plain of said flow path and an exit positioned coaxially within said flow path; and a plurality of mixer elements each comprising a channel segment in said flow path, each of said channel segments lying in one of a first layer and a second layer of said apparatus, each of the channel segments in the first layer extending in a first direction and each of the channel segments in the second layer extending in a second direction perpendicular to said first direction, the channel segments alternating successively between the first and second layers.

2. The mixer apparatus of claim 1 wherein each of said at least one mixer elements is further characterized by a chamber disposed at an end of said channel segment wherein each chamber further contains at least one obstacle.

3. The mixer apparatus of claim 1 wherein at least one obstacle is situated anywhere in said flow path.

4. The mixer apparatus of claim 2 wherein said channel segment is further characterized by at least one restriction, said segment having a height in the range of 100 μm to 5000 μm, a width in the range of 100 μm to 10000 μm, and a length in the range of 200 μm to 10000 μm and said restriction having a radius in the range of 50 μm to 2500 μm and a height in the range of 100 μm to 5000 μm.

5. The mixer apparatus of any one of claims 2 to 4 wherein inner dimensions of said chamber is reduced in the presence of said at least one obstacle and wherein increased dimensions of said obstacle increase said mixing efficiency.

6. The mixer apparatus of claim 5 wherein said at least one obstacle is further characterized by having a cylindrical geometry with a radius in the range of 50 μm to 4000 μm and a height of 100 μm to 5000 μm; and wherein said inner dimensions of said chamber containing said at least one obstacle are further characterized by a radius in the range of 100 μm to 5000 μm, a perimeter from 600 μm to 30 mm, a surface area from 3 $mm^2$ to 80 $mm^2$, a volume from 0.3 $mm^3$ to 120 $mm^3$, and a height in the range between 100 μm and 5000 μm.

7. The mixer apparatus of claim 1 wherein the injection zone comprises two co-axial injection passages positioned within said flow path having respective entries outside the plain of said flow path and respective exits positioned coaxially within said flow path and wherein the two coaxial injection passages are co-axial with each other and the respective exits are positioned at a common position along said flow path.

* * * * *